US005607133A

United States Patent [19]

Markham et al.

[11] Patent Number: 5,607,133

[45] Date of Patent: Mar. 4, 1997

[54] APPARATUS AND METHOD FOR SUPPORTING A CYLINDRICAL TANK

[75] Inventors: Howard L. Markham; Perry D. Markham, both of Rosemead, Calif.

[73] Assignee: E-Z Metal Products, Inc., Ontario, Calif.

[21] Appl. No.: 191,870

[22] Filed: Feb. 4, 1994

[51] Int. Cl.[6] ..... A47K 1/08

[52] U.S. Cl. ..... 248/313; 248/146; 248/154; 248/298.1

[58] Field of Search ..... 248/146, 154, 248/201, 298.1, 300, 311.2, 313, 505, 152

[56] References Cited

U.S. PATENT DOCUMENTS

| | | | |
|---|---|---|---|
| 1,867,892 | 7/1932 | Rice | 248/154 |
| 1,995,202 | 3/1935 | Fleming, Jr. | 248/146 |
| 2,226,713 | 12/1940 | Folmsbee | 248/146 X |
| 2,277,737 | 3/1942 | Wilkinson | 248/201 X |
| 4,097,002 | 6/1978 | Krueger | 248/201 X |
| 4,124,185 | 11/1978 | Preisinger | 248/201 X |
| 4,955,573 | 9/1990 | Horvath | 248/154 X |
| 5,020,760 | 6/1991 | Mayr | 248/313 |
| 5,190,260 | 3/1993 | Daubenpeck | 248/313 |

*Primary Examiner*—Derek J. Berger

*Attorney, Agent, or Firm*—Lewis Anten, Esq.; Amedeo Ferraro, Esq.

[57] ABSTRACT

Apparatus and method for use in holding a cylindrical tank secure and preventing it from being dislodged during an earthquake is disclosed. A pair of mounting brackets are attached to a supporting surface on either side of the cylindrical tank through holes in the mounting brackets by threaded bolts. An adjustable stabilizer bracket is positioned between the cylindrical tank and the supporting wall to keep the cylindrical tank from moving towards the wall. The adjustable stabilizer bracket adjusts to accommodate a variety of different sizes of cylindrical tanks and has angled end portions to conform to the shapes of the different cylindrical tanks. The mounting brackets are pivotally attached to a securing strap, that has a series of holes in it for receiving a bolt. The securing strap is fitted around the cylindrical tank to secure it in place. The pivotal attachment of the securing strap permits the securing strap to move relative to the mounting brackets when the cylindrical tank is moved during an earthquake so that stress on the mounting brackets is substantially reduced.

3 Claims, 2 Drawing Sheets

10
12
20
21
22
24
26
27
28
30
32
34
37
38
40
41
42
43
44
45
46
50
52
60

APPARATUS AND METHOD FOR SUPPORTING A CYLINDRICAL TANK

BACKGROUND

1. Field of the Invention

This invention relates to an apparatus and method for securing and holding a cylindrical tank and in particular to an apparatus and method for preventing the dislodgement of the tank during an earthquake.

2. Description of the Related Art

During earthquakes there is a serious concern with water heater tanks falling over or twisting sufficiently to break their gas connections. This is particularly true in the Southern California area of the United States where most water heaters are located in a compartment within the house frame. If the gas line is separated from the water heater there is a real threat of an explosion due to the free flowing gas and the flame of the water heater.

In the past there have been various approaches to holding water heater tanks firmly in place to prevent dislodgement or having the gas line separate. One approach has been to use a metal band that is nailed to the studs in a nearby wall. The metal band of that approach has openings at the ends and nails are driven through the openings after the bands have been placed around the water heater.

A similar system for maintaining the cylindrical tank in place is shown in Southern California Edison "Customer Update" dated April 1993. In the Southern California Edison system, two bands of metal plumbers tape are fitted to completely encircle the tank of the water heater. The bands are each formed from two metal securing straps having holes drilled in the ends through which a bolt passes to secure the bands to the studs of a wall or other supporting surface.

The above described systems have disadvantages and difficulties that are not ideal for preventing the dislodgement of a water heater tank during an earthquake. For example, in the systems utilizing nails, the nails can easily be ripped out of the wall by the movement of the water heater, particularly during a violent earthquake where the movement of the water heater exerts a great amount of force on the nails. Similarly, in the Edison system there is no means for reducing the stress on the attachment points of the bands to the supporting surface. These stress points are particularly susceptible to breaking when the stress resulting from the movement of the cylindrical tank is great and thus fail to support the cylindrical tank. Moreover, the Edison system is complex requiring the use of a number of tools for assembly and is also time consuming to assemble.

SUMMARY OF THE INVENTION

The present invention provides an apparatus and method for holding a cylindrical tank secure and for preventing the dislodgement of a cylindrical tank during an earthquake. The apparatus of the present invention comprises an adjustable stabilizer bracket, a pair of mounting brackets and a securing strap. The adjustable stabilizer bracket fits between a supporting surface, such as a wall, and the cylindrical tank. The adjustable stabilizer bracket functions to secure the tank and to keep the tank at a safe distance from the wall. In the preferred embodiment, the adjustable stabilizer bracket has two members which are slideably and removably attached to each other with each member having an angled portion that abuts the cylindrical tank. The angled portion of each member permits the adjustable stabilizer bracket to conform to different sizes of cylindrical tanks. In addition, as the two members o f the stabilizer bracket are removable from one another, each member can be mounted to adjacent walls in a corner to secure a corner mounted cylindrical tank. The adjustable stabilizer bracket is also slideably adjustable to fit a variety of cylindrical tanks having different diameters.

The adjustable stabilizer bracket is mounted to a supporting wall by a pair of mounting brackets having ends which are at 90 degrees to the rest of the mounting bracket which are preferably attached to wall studs on either side of a cylindrical tank. Once the stabilizer bar is in place and is mounted to the supporting surface by the mounting brackets, a securing strap is fitted around the cylindrical tank. The securing strap is then pivotally attached at a portion near each of its ends to one of the mounting brackets.

The pivotable mounting of the securing strap to the mounting brackets permits the cylindrical tank to move slightly up and down to permit some relief of the tension and force exerted on the mounting brackets when the cylindrical tank moves during an earthquake. The adjustable stabilizer bracket prevents rearward movement of the cylindrical tank and maintains the cylindrical tank at a safe distance from the wall. Also, the use of threaded bolts to mount the mounting brackets prevents the backing out of the bolts from the wall studs.

Although a single apparatus of the present invention may be used to secure a tank, it is preferred to utilize two or more apparatus of the present invention so that a first securing strap, an adjustable stabilizer bracket and a pair of mounting brackets are placed near the bottom of the tank and a second securing strap, adjustable stabilizer bracket, and pair of mounting brackets are placed near the top of the tank desired to be secured.

OBJECTS OF THE INVENTION

It is an object of the present invention to provide an improved apparatus for holding a cylindrical tank in place;

It is another object of the present invention to provide an improved apparatus for holding a cylindrical tank that is easy to use;

It is yet another object of the present invention to provide an improved apparatus for holding a cylindrical tank that is inexpensive;

It is a further object of the present invention to provide an improved apparatus for holding a cylindrical tank that is safe;

It is yet a further object of the present invention to provide an improved apparatus for holding a cylindrical tank that is reliable;

It is also another object of the present invention to provide an improved apparatus for holding a cylindrical tank that is adjustable to fit a variety of tanks having different diameters; and It is yet another object of the present invention to provide an apparatus for holding a cylindrical tank that is easily removable in order to access or remove the cylindrical tank.

These and other objects of the present invention will be apparent from a review of the accompanying drawings and the following detailed description of the drawings.

DETAILED DESCRIPTION OF THE DRAWINGS

Figures 1, 2, 3:
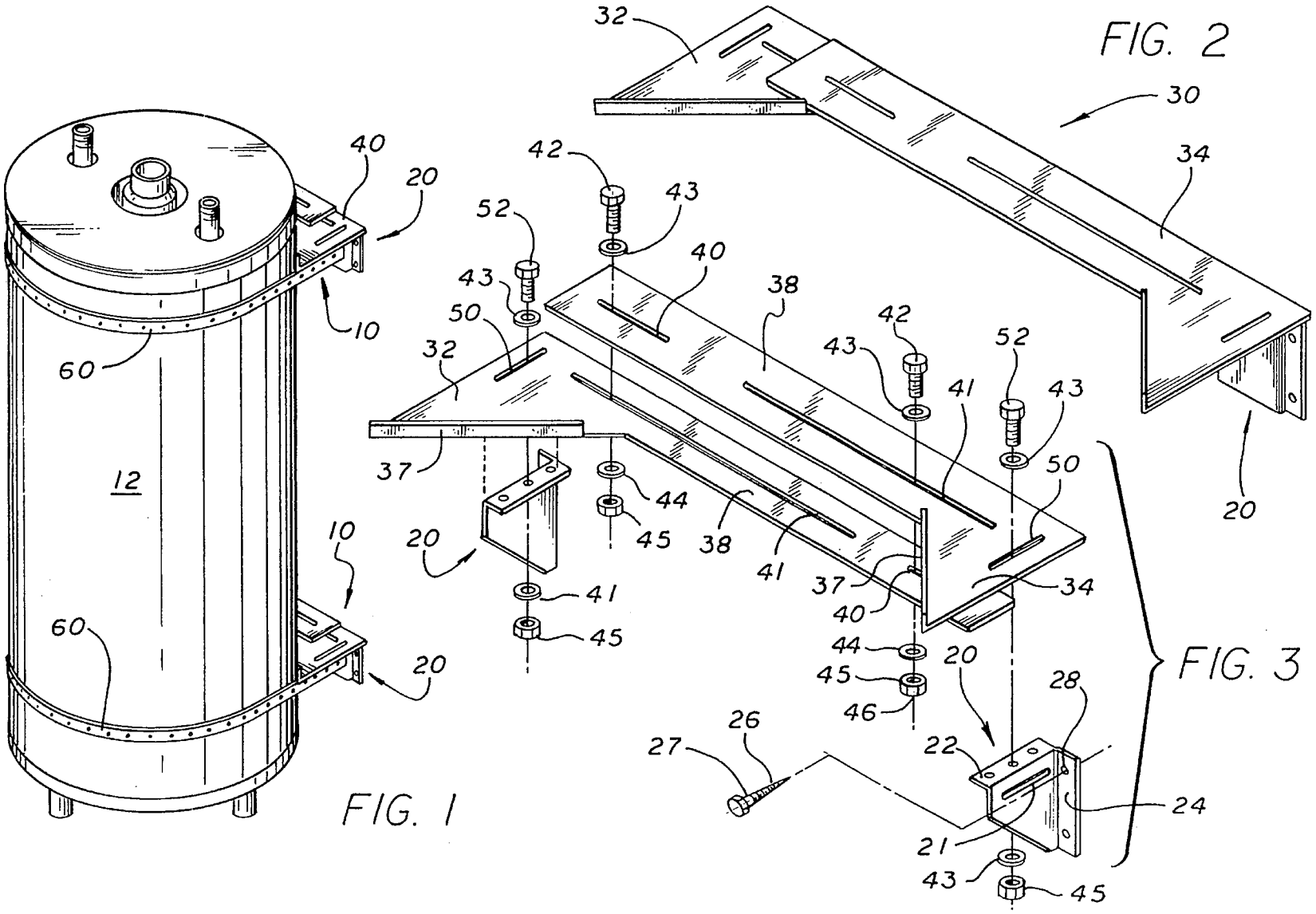
FIG. 1 is a perspective front view of a cylindrical tank secured in place by the apparatus of the present invention
FIG. 2 is a perspective view of the rear adjustable stabilizer bracket of the apparatus of the present invention
FIG. 3 is an exploded view of the rear adjustable stabilizer bracket of the apparatus of the present invention

Referring to FIGS. 1–3, the apparatus 10 of the present invention is shown holding and securing a cylindrical tank 12. The apparatus 10 comprises a pair of identical mounting brackets 20 each having a flat upper portion 22, a slot 21 located below the flat upper portion 22 for receiving a bolt therethrough, and a flat side portion 24. The flat upper portion 22 is bent at a 90 degree angle relative to the rest of the mounting bracket 20 and has mounting holes 25 for receiving a bolt therethrough. The flat side portion 24 of the mounting bracket 20 has holes 28 for receiving a bolt therethrough.

Figure 4:
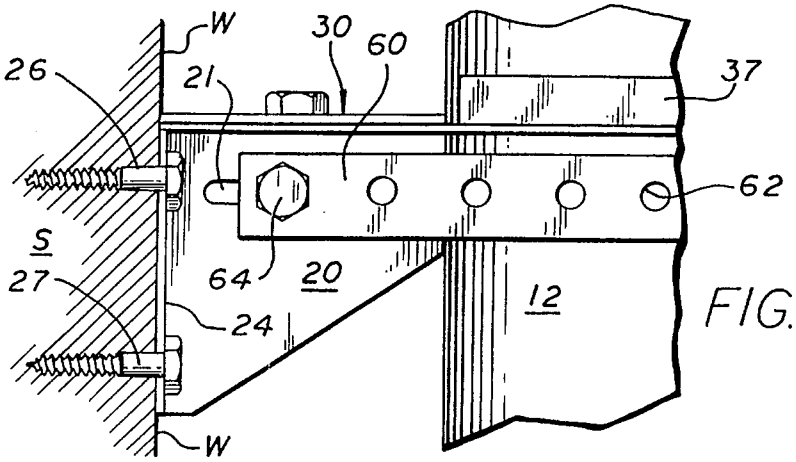
FIG. 4 is an enlarged partial side view of the apparatus of the present invention mounted to a wall shown in partial cross section.

Referring to FIG. 4, when the mounting bracket 20 is mounted to a wall W, the flat side portion 24 of mounting bracket 20 is placed flat against the surface of wall W. The mounting bracket 20 is mounted to the wall W by a long threaded bolt 26 having a thread suitable for engaging wood, such as a hex lag screw, which passes through one of the mounting holes 28 of the flat side portion 24 and is screwed into a wall stud S. Similarly, a second long threaded bolt 27 identical to bolt 26 passes through another of the holes 28 of the flat side portion 24 to further secure the mounting bracket 20 to the wall stud S. In the preferred embodiment, long threaded bolts 26 and 27 are approximately 1 ½ inches long with a diameter of approximately ⅜ inches.

Figure 5:
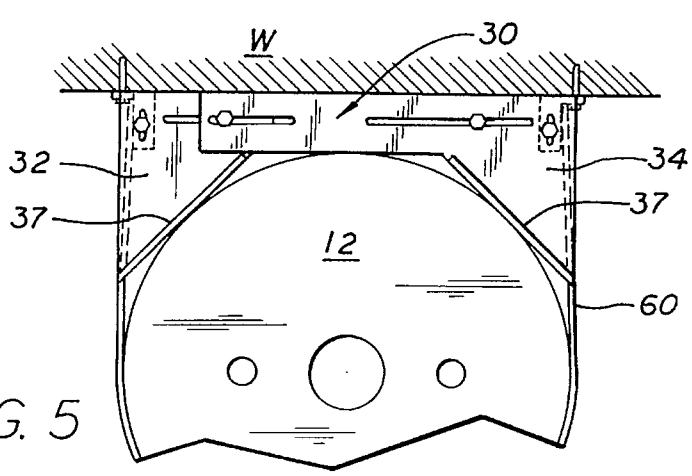
FIG. 5 is a top plan view of the apparatus of the present invention securing a cylindrical tank to a flat wall.

Referring to FIG. 5, between the supporting wall W and the cylindrical tank 12 is positioned a rear adjustable stabilizer bracket 30 having a left member 32 and a right member 34 which serves to support the cylindrical tank 12 and to keep the tank away from the supporting wall W. The left and right members 32 and 34 are mirror images of each other, each having an angled end portion 36 with a raised lip portion 37 which abuts the surface of the cylindrical tank 12. The angled end portion 36 extends to form a center portion 38 having two slots 40 and 41 through which bolts 42 and 43 can pass as shown in FIG. 2. The bolts 42 and 43 first pass through washers 43 then through slots 40 and 41, respectively, through washers 44 and are then secured by lock nuts 45. Lock nuts 45 each have a nylon threaded portion 46 to securely lock the lock nuts 45 to the bolts 42 and 43 and prevent any unwanted loosening which tends to occur during an earthquake.

In the preferred embodiment, the angled end portion 37 is positioned at a 49 degree angle relative to the center portion 38. This specific angular orientation allows for the adaptability of the rear adjustable stabilizer bracket 30 to a variety of different sizes of cylindrical tanks and provides a secure fit of the rear adjustable stabilizer bracket 30 with the cylindrical tank 12. The angled end portion 36 of the rear adjustable stabilizer bracket 30 has a slot 50 through which a bolt 52 can pass for securing the angled end portion 36 to a mounting bracket 20.

When the rear adjustable stabilizer bracket 30 is assembled, the left and right members 32 and 34 are superimposed on one another so that the center portions 38 of each member 32 and 34 overlap and the angled end portions 36 are at opposite ends of the rear adjustable stabilizer bracket 30. The left and right members 32 and 34 are slideably mounted to each other by the bolts 42 and 43 which pass through the slots 40 and 41 and are secured by lock nuts 45. The slidable mounting of the left and right members 32 and 34 permits the rear adjustable stabilizer bracket 30 to adjustably fit a variety of cylindrical tanks having different diameters.

For example, in the preferred embodiment the left and right members 32 and 34 have an overall length of approximately 14 inches; the center portion 38 has a width of approximately 3 inches; the angled end portion 36 is approximately 7 ½ inches at its widest point; the slot 40 is approximately 7 ½ inches long; the slot 41 is approximately 3 inches long; and the raised lip portion 37 is approximately ½ inches in height.

The width of the center portion 38 of the rear adjustable stabilizer bracket 30 maintains the cylindrical tank at least 3 inches away from the supporting wall W. This is an important feature as many states have safety codes requiring a minimum of a 2 inch clearance from combustible walls for cylindrical tanks. The center portion 38 of the rear adjustable stabilizer bracket 30 easily provides more than two inches of clearance from the wall W.

In the preferred embodiment, the rear adjustable stabilizer bracket 30 is capable of securing a cylindrical tank 12 having a diameter of 15 ¾ inches (the smallest size for a conventional cylindrical water heater tank) and is expandable to secure a larger cylindrical tank 12 having a diameter of approximately 24 inches. The rear adjustable stabilizer bracket 30 is adjusted by simply loosening the bolts 42 and 43 so that the left and right members 32 and 34 may be slided apart or closer to each other depending on the size of the cylindrical tank 12 desired to secure.

Figure 6:
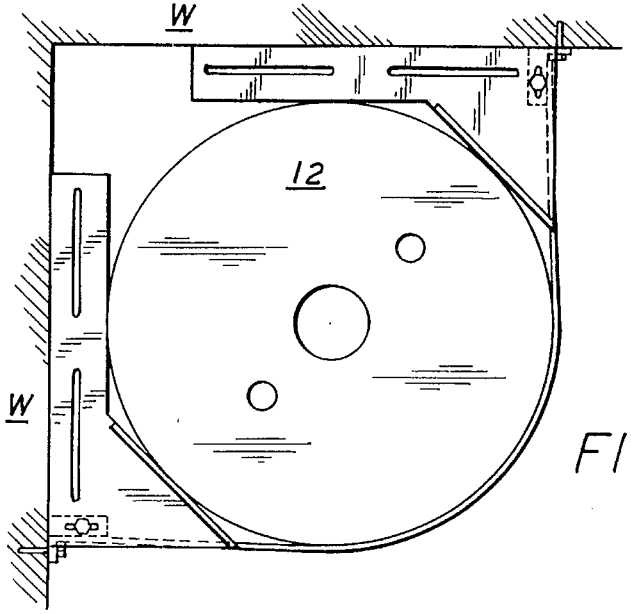
FIG. 6 is a top plan view of the apparatus of the present invention securing a cylindrical tank to the corner of two adjacent walls.

Referring to FIG. 6, the rear adjustable stabilizer bracket 30 may be unassembled to permit corner placement and securement of a cylindrical tank 12. The left and right members 32 and 34 are separated from one another so that the left member 32 is mounted to one wall and the right member 34 is mounted to another adjacent wall that form the corner. In this configuration, the rear adjustable stabilizer bracket 30 still keeps the cylindrical tank 12 at a sufficient distance from the supporting wall W and prevents movement of the cylindrical tank 12 towards the adjacent walls W.

Referring to FIGS. 1 and 4, once the rear stabilizer bracket 30 is mounted to the mounting brackets 20 a flexible securing strap 60 for supporting the exterior of the cylindrical tank 12 is placed around the circumference of the cylindrical tank 12. The flexibility of securing strap 60 permits the securing strap 60 to conform to the curved shape of the exterior of a cylindrical tank 12 so that it can be fitted in close proximity to the tank 12. The securing strap 60 may be made of metal or any other suitable heat resistant material that has flexible characteristics, such as a Teflon coated plastic material. The securing strap 60 has multiple holes 62 evenly spaced at regular intervals throughout the length of the securing strap 60 and centered in the width of the securing strap 60. The holes 62 allow for easy adjustment of the apparatus 10 so that it may fit different sizes of cylindrical tanks, including tanks having an insulation blanket covering their exterior.

In the preferred embodiment, the securing strap 60 is approximately 1 inch wide and 1/16 inches thick with the length varying with the size of the cylindrical tank. Typically for a standard cylindrical tank 12 having a diameter of approximately 15 ¾ inches, a securing strap 60 having a length of approximately 40 inches would be used. The holes 62 in securing strap 60 have a diameter of approximately ¼ inches and are spaced at regular intervals of approximately ¼ inches apart from one another.

Once the securing strap 60 is placed around the cylindrical tank 12, one of the mounting bracket 20 is pivotally attached to a portion near one end of the securing strap 60 with a threaded locking bolt 64 which is identical to bolts 42 and 43 and passes through slot 21 of the mounting bracket 20 and then through a hole 62 of the securing strap 60. A washer 43 is placed between the securing strap 60 and a lock nut 45 which is threaded to the locking bolt 64 and tightened to secure the mounting bracket 20 to the securing strap 60. The locking nut 45 has nylon portion 46 at the end of its internal thread 66 in order to prevent the lock nut from unwanted loosening.

Once the securing strap 60 is pivotally attached to one mounting bracket 20, the securing strap 60 is pivotally attached at a portion near its other end to a second mounting bracket 20. The second mounting bracket 20 is positioned on the securing strap 60 at the appropriate hole 62 to provide a snug fit between the cylindrical tank 12 and the securing strap 60.

It is critical to the essence of the present invention that the lock nut 45 securing the locking bolt 64 not be overtightened so that a slight movement of the securing strap 60 about the central axis of locking bolt 64 between the washer 43 and the mounting bracket 20 is permitted. In the event of an earthquake, the cylindrical tank 12 exerts a force on the securing strap 60, which in response to the movement of the cylindrical tank 12, pivots about the central axis of locking bolt 64. This pivotal movement reduces the magnitude of the force related to the mounting brackets 20 and thus reduces the stress exerted on the mounting brackets 20. The reduction of the stress forces imparted on the mounting brackets 20 consequently reduces the stress exerted on the bolts 26 and 27 so that they are not pulled out of the wall W. The rear adjustable stabilizer bracket 30 prevents the rearward movement of the cylindrical tank 12 to further prevent dislodgement and to stabilize the cylindrical tank 12. In addition the thread of long threaded bolts 26 and 27 also reduce the chances that they will be pulled out of the wall W.

In the preferred embodiment, two identical apparatus 10 having securing straps 60, a pair of mounting brackets 20, and a rear adjustable stabilizer bracket 30 are placed on the cylindrical tank 12, with one apparatus 10 near the bottom of the cylindrical tank 12, and the other apparatus 10 near the top portion of the cylindrical tank 12. Each of the apparatus 10 is mounted to the wall W by mounting brackets 20 as described above.

While the present invention has been described with regards to the preferred embodiment, it is understood that variation to the present invention may be made without departing from the concept of the present invention.

Figure 7:
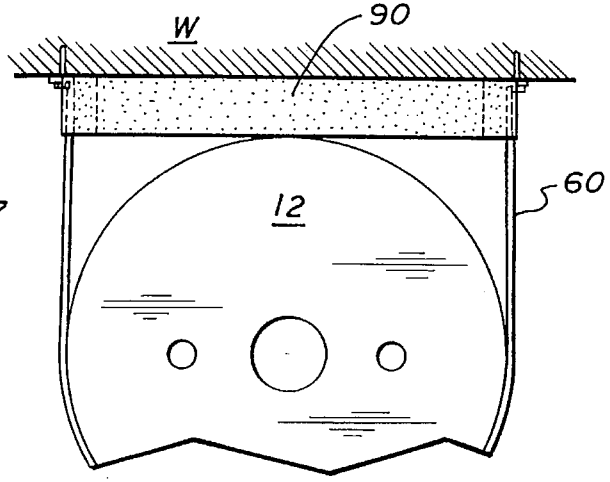
FIG. 7 shows an alternative embodiment of the rear bracket of the apparatus of the present invention.

For example, referring to FIG. 7, as an alternative to the rear adjustable stabilizer bracket, a support bolster 90 made of a non combustible material may be used to keep the cylindrical tank 12 at least two inches from the support wall W. The bolster 90 serves to prevent the rearward movement of the cylindrical tank 12 during an earthquake.

As another example, while in the preferred embodiment of the present invention two securing straps are used to secure the cylindrical tank 12, an alternative embodiment of the present invention would employ a single securing strap 60 that is wider than strap 60 of the preferred embodiment to secure the middle portion of the cylindrical tank 12 so that only one apparatus 10 is used to secure the cylindrical tank 12.

A further alternative embodiment of the present invention would include the use of a shock absorbing means positioned between the mounting brackets 20 and the securing strap 60 for further reducing the stress imparted by the movement of a cylindrical tank to the brackets.

While the present invention has been described with respect to the preferred embodiment as it relates to cylindrical tanks, the apparatus of the present invention may also be used in supporting and securing other structures and objects of various shapes and sizes in the event of an earthquake without departing from the concept of the present invention.

What I claim is:

1. An apparatus for securing a cylindrical tank to a wall comprising:

a flexible securing strap, said securing strap having length adjusting means for adjusting its length;

a pair of wall mounting brackets, each of said wall mounting brackets having a first portion for pivotal attachment to a section of said securing strap proximate to an end of said securing strap and a second portion for attachment to a wall, said securing strap being pivotally attached to said mounting brackets, whereby said securing strap is pivotable in a vertical direction; and a rear longitudinal stabilizer member attachable at each of its two ends to one of said wall mounting brackets, whereby said rear stabilizer member is positionable between the cylindrical tank and the wall, said rear stabilizer means comprises an adjustable stabilizer bracket having a first member and a second member slideably engaging each other, each of said first and second members having an angled end portion and a straight center portion, said angled end portion having a surface adapted to abut the cylindrical tank being secured by said apparatus.

2. The apparatus of claim 1 in which said angled end portion is disposed at a 50 degree angle relative to said center portion.

3. The apparatus of claim 1 in which said first and second members are separable and separately mountable to adjacent walls forming a corner.

* * * * *